US005904137A

United States Patent [19]

Salley

[11] Patent Number: 5,904,137

[45] Date of Patent: May 18, 1999

[54] FIREPLACE HEAT EXCHANGER

[76] Inventor: Dwight Salley, 31277 Conrad Seals, Franklinton, La. 70438

[21] Appl. No.: 08/877,360

[22] Filed: Jun. 17, 1997

[51] Int. Cl.[6] ..... F24B 1/189

[52] U.S. Cl. ..... 126/522; 126/530; 126/540

[58] Field of Search ..... 126/516–518, 126/521, 522, 523, 530, 285 R, 289, 290, 540

[56] References Cited

U.S. PATENT DOCUMENTS

| | | | |
|---|---|---|---|
| 3,452,737 | 7/1969 | Pellegrino et al. | 126/521 |
| 4,114,590 | 9/1978 | Frahm | 126/522 |
| 4,193,387 | 3/1980 | Cline | 126/522 |
| 4,240,401 | 12/1980 | Chestnut et al. | 126/522 |
| 4,258,879 | 3/1981 | Nischwitz | 237/51 |
| 4,445,497 | 5/1984 | Kildlay, Sr. | 126/121 |
| 4,535,752 | 8/1985 | Cagle | 126/121 |
| 4,694,818 | 9/1987 | Bridgewater | 126/121 |
| 4,738,241 | 4/1988 | Bernelov et al. | 126/530 |

*Primary Examiner*—James C. Yeung
*Attorney, Agent, or Firm*—Joseph N. Breaux

[57] ABSTRACT

A fireplace heat exchanger that includes an air blower unit having an input for drawing air into the air blower unit and an output for expelling air from the air blower unit; a heat exchange unit, in airflow connection with the output of the air blower unit, having at least four heat exchange sections and an airflow passageway running through the at least four heat exchange sections and terminating in a heat exchange output port; at least one log retainer extending outwardly from an upper surface of the heat exchange unit; a heated air discharge manifold having a manifold chamber in airflow communication with the heat exchange output port of the heat exchange unit, an elongated air discharge vent formed through a front manifold surface thereof and two spaced manifold bolts extending from the front manifold surface thereof; a combination vent restricting and directing assembly that includes a pivoting deflecting panel, left and right deflecting panel supports extending from a U-shaped base plate having two parallel oriented sections, and left and right deflecting panel locking nuts threaded onto left and right deflecting panel guide bolts, the U-shaped base plate having an elongated positioning channel formed in each of parallel oriented sections thereof that are each positioned over one of the two spaced manifold bolts that extend from the front manifold surface; and two manifold locking nuts, each of the manifold locking nuts being threaded onto one of the two spaced manifold bolts.

17 Claims, 3 Drawing Sheets

FIREPLACE HEAT EXCHANGER

TECHNICAL FIELD

The present invention relates to devices and methods for extracting additional heat from a fireplace and more particularly to a fireplace heat exchanger having a heat exchanger unit, an air blower, a heated air discharge manifold, a combination vent restricting and directing assembly, and two manifold locking nuts, and wherein the heated air discharge manifold has a manifold chamber in airflow communication with a heat exchange output port of the heat exchange unit, an elongated air discharge vent formed through a front manifold surface thereof and two spaced manifold bolts extending from the front manifold surface thereof; the combination vent restricting and directing assembly includes a pivoting deflecting panel, left and right deflecting panel supports extending from a U-shaped base plate having two parallel oriented sections, and left and right deflecting panel locking nuts threaded onto left and right deflecting panel guide bolts, the U-shaped base plate having an elongated positioning channel formed in each of parallel oriented sections thereof that are each positioned over one of the two spaced manifold bolts that extend from the front manifold surface; and each of the two manifold locking nuts is threaded onto a threaded manifold bolt end of one of the two spaced manifold bolts.

BACKGROUND ART

Many homes and offices are equipped with fireplaces to provide heat during cold weather. The heat is generated by burning logs or log substitutes within the fire chamber of the fireplace. Radiant heat from the burning material heats the room. Although the radiant heat generated by the burning material supplies heat to the room, the majority of the heat generated by the burning material is discharged through the flue of the fireplace and out through the chimney in the form of heated gases. These gasses are required to be discharged for safety reasons and cannot be vented into the home or office without seriously endangering the occupants thereof. It would, however, be a benefit to have a device for capturing at least a portion of the heat from these dangerous heated gasses and transferring the captured heat into the home or office prior to discharging the dangerous gasses out through the flue of the fireplace. Because many existing fireplaces could benefit from such a device, it would be a further benefit if the device could be easily installed within an existing fireplace. Additionally, it would be a further benefit if the device could detect the presence of a fire within the fireplace and activate an air blower unit for blowing air through a heat exchanger positioned within the fireplace at a location that allows heat from the burning material to be transferred to the air passing through the heat exchanger. It would also be a benefit if the device could detect when a fire within the fireplace had burned out and deactivate the blower.

GENERAL SUMMARY DISCUSSION OF INVENTION

It is thus an object of the invention to provide a fireplace heat exchanger that can capture at least a portion of the heat from the burning material within a fireplace and transfer the captured heat into a room.

It is a further object of the invention to provide a fireplace heat exchanger that can be easily installed within an existing fireplace.

It is a still further object of the invention to provide a fireplace heat exchanger that includes a mechanism for detecting the presence of a fire within the fireplace and activating an air blower unit for blowing air through a heat exchange unit positioned within the fireplace at a location that allows heat from the burning material to be transferred to the air passing through the heat exchange unit.

It is a still further object of the invention to provide a fireplace heat exchanger that includes a mechanism for detecting when a fire within the fireplace had burned out and deactivating an air blower unit.

It is a still further object of the invention to supply a fireplace heat exchanger that accomplishes all or some of the above objects in combination.

Accordingly, a fireplace heat exchanger is provided. The fireplace heat exchanger comprises an air blower unit having an input for drawing air into the air blower unit and an output for expelling air from the air blower unit; a heat exchange unit, in airflow connection with the output of the air blower unit, having at least four heat exchange sections and an airflow passageway running through the at least four heat exchange sections and terminating in a heat exchange output port; at least one log retainer extending outwardly from an upper surface of the heat exchange unit; a heated air discharge manifold having a manifold chamber in airflow communication with the heat exchange output port of the heat exchange unit, an elongated air discharge vent formed through a front manifold surface thereof and two spaced manifold bolts extending from the front manifold surface thereof; a combination vent restricting and directing assembly that includes a pivoting deflecting panel, left and right deflecting panel supports extending from a U-shaped base plate having two parallel oriented sections, and left and right deflecting panel locking nuts threaded onto left and right deflecting panel guide bolts, the U-shaped base plate having an elongated positioning channel formed in each of parallel oriented sections thereof that are each positioned over one of the two spaced manifold bolts that extend from the front manifold surface; and two manifold locking nuts, each of the manifold locking nuts being threaded onto a threaded manifold bolt end of one of the two spaced manifold bolts.

It is preferred to also provide a control circuit that activates the air blower unit when a thermocouple, or other heat sensing mechanism such as a thermostat, in connection with the control circuit is heated by a fire burning within the fireplace during use. The thermocouple is preferably housed within a dogleg shaped thermocouple extension tube positioned through the sidewall of the heat exchange unit. In addition, to assist in leveling the exemplary fireplace heat exchanger during installation, it is preferred to provide at least one, and more preferably two, rear height adjustment mechanisms. The rear height adjustment mechanisms preferably each include an internally threaded adjustment nut welded to the sidewall of a rear portion of the heat exchange unit and an externally threaded standoff that includes a central threaded rod section threaded into the internally threaded adjustment nut and having a notched upper end for receiving the tip of a screw driver and a lower semi-spherical shaped contact end for contacting the floor of the fireplace.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
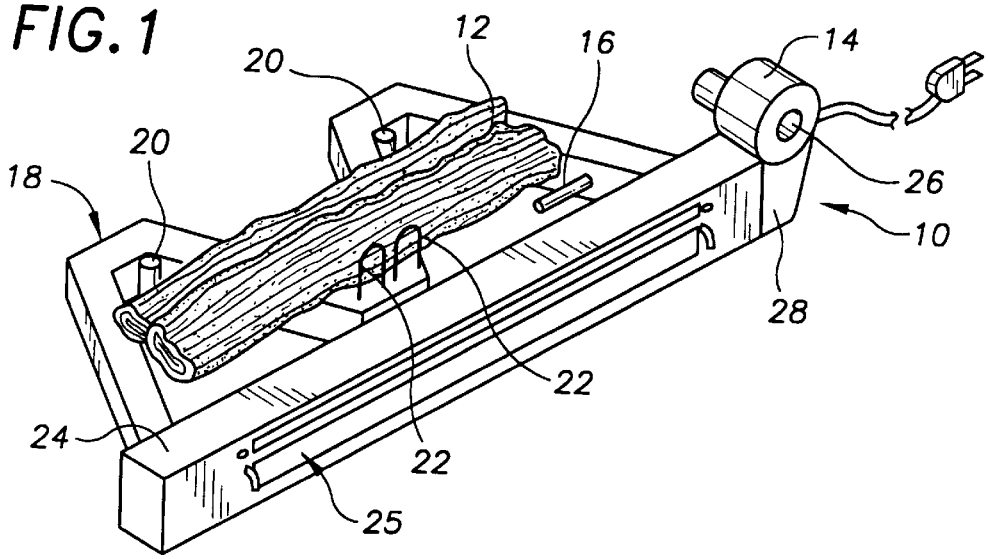
FIG. 1 is a perspective view of an exemplary embodiment of the fireplace heat exchanger of the present invention showing the electric air blower, the thermocouple extension tube, the M-shaped heat exchange unit, the two rear height adjustment mechanisms, the two arch-shaped log retainers, the heated air discharge manifold with the elongated air discharge vent, and the combination vent restricting and airflow directing assembly.

FIG. 1 shows an exemplary embodiment of the fireplace heat exchanger of the present invention, generally designated by the numeral 10, with three representative fire logs 12 positioned thereon. Fireplace heat exchanger 10 includes an electric air blower unit 14; a thermocouple installed within a thermocouple extension tube 16; an M-shaped heat exchange unit, generally designated 18; two rear height adjustment mechanisms 20; two arch-shaped log retainers 22; a heated air discharge manifold 24; and a combination vent restricting and directing assembly, generally designated 25.

Air blower unit 14 is a conventional electrically powered air blower having an air input 26 for drawing air into air blower unit 14 and an air output 28 (more clearly shown in FIG. 2) for expelling air from air blower unit 14. In this embodiment, air blower unit 14 is controlled by a conventional thermocouple control circuit utilizing a conventional comparator integrated circuit chip in connection with a conventional bimetal thermocouple installed within thermocouple extension tube 16. When thermocouple 16 is heated above one-hundred-twenty degrees Fahrenheit the control circuit activates air blower unit 14. Air blower unit 14 continues to run until the temperature of thermocouple 16 falls below one-hundred twenty degrees. Arch shaped log retainers 22 are formed from lengths of steel rod that have been bent into shape and welded to the upper exterior surface of heat exchange unit 18.

Figure 2:
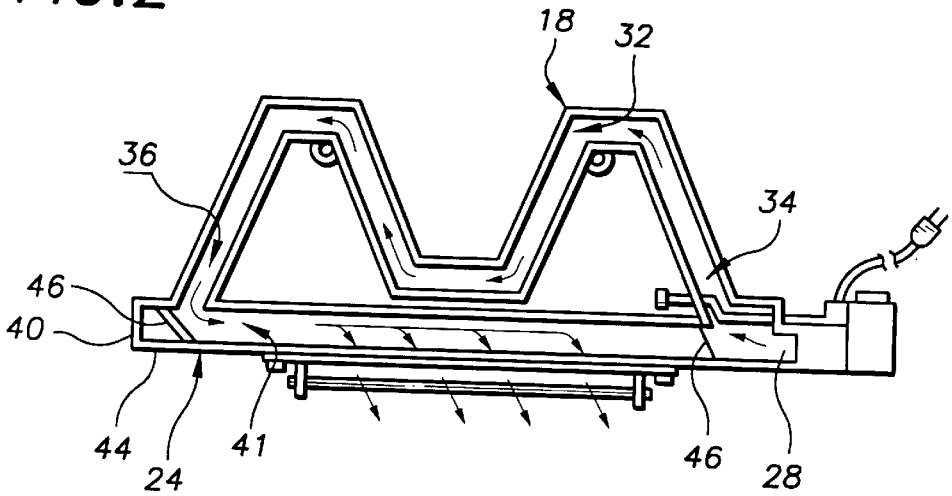
FIG. 2 is a top plan view of the exemplary fireplace heat exchanger of FIG. 1 with the top surfaces of the M-shaped heat exchange unit and the heated air discharge manifold removed to show the air passageways formed therein, the first and second angled flow directing plates installed within the heated air discharge manifold, and the dogleg shaped thermocouple extension tube positioned through the sidewall of the M-shaped heat exchange unit.

In this embodiment heat exchange unit 18 is constructed from seven sections of two-by-five (2"×5") inch steel rectangular cross-section tubing that have been cut to length and welded together to form an M-shaped configuration. With reference to FIG. 2, an airflow passageway 32 is provided along the entire length of heat exchange unit 18. Airflow passageway 32 is in connection with air blower output 28 at a first end 34 thereof and in connection with a manifold chamber 41 formed within heated air discharge manifold 24 at a second end 36 thereof.

Heated air discharge manifold 24 is constructed from a length of two-by-five (2"×5") inch steel rectangular cross-section tubing that has been capped at one end 40 thereof. Heated air discharge manifold 24 is provided with openings along the two inch sides thereof that are placed in registration with first and second ends 34,36 of air passageway 32 and welded to heat exchange unit 18. Heated air discharge manifold 24 is provided with two planar, steel flow plates 46 oriented at a forty-five degree angle with respect to a front surface 44 heated air discharge manifold 24. Use of flow plates 46*a*,46*b* helps direct the flow of air through heat exchanger 10 and helps to minimize dead air spaces therein.

Figure 3:
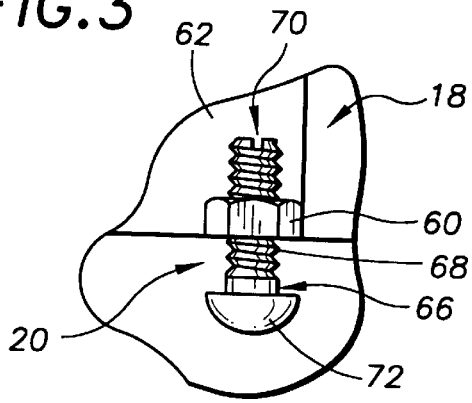
FIG. 3 is a detail plan view of one of the two identical rear height adjustment mechanisms showing the threaded nut welded to the sidewall of a rear portion of the M-shaped heat exchange unit and the threaded standoff including the central threaded rod section having a notched upper end and a lower semi-spherical shaped contact end.

With reference now to FIG. 3, each rear height adjustment mechanism 20 includes a threaded nut 60 that is welded to the sidewall 62 of a rear portion of M-shaped heat exchange unit 18 and a threaded standoff, generally designated 66, that includes a central threaded rod section 68 that has a notched upper end 70 and a lower semi-spherical shaped contact end 72. Notched upper end 70 is sized to receiving the tip end of a conventional slot type screwdriver.

Figure 4:
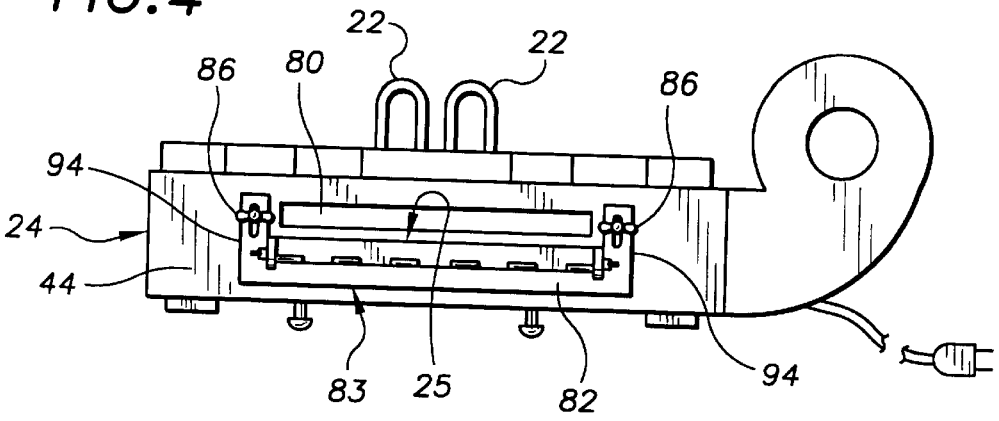
FIG. 4 is a plan view of the exemplary fireplace heat exchanger of FIG. 1 showing the electric air blower, a top portion of the M-shaped heat exchange unit rising above the heated air discharge manifold, the contact ends of the two rear height adjustment mechanisms, the two arch-shaped log retainers, the front of the heated air discharge manifold, the elongated air discharge vent, and the combination vent restricting and directing assembly.
Figure 5:
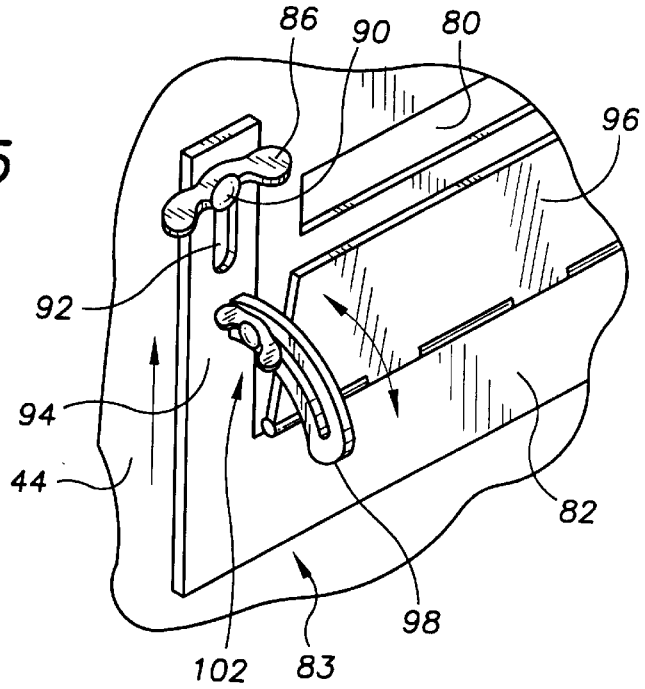
FIG. 5 is a detail plan view of the corner of the front of the heated air discharge manifold showing one end of the elongated air discharge vent, one of the two manifold bolts, and a corner of the combination vent restricting and directing assembly.

With reference to FIG. 4, heated air discharge manifold 24 is provided with a single elongated heated air discharge vent 80 through the front manifold surface 44 of heated air discharge manifold 24 and into airflow communication with manifold chamber 41 (FIG. 3). A lower portion 82 of a U-shaped base plate 83 of combination vent restricting and directing assembly 25 is slidably positionable over single elongated heated air discharge vent 80 and is securable in place with two manifold locking nuts 86. With reference to FIG. 5, in this embodiment lower portion 82 of a U-shaped base plate 83 has a width equal to one and one-half times the width of elongated heated air discharge vent 80. Each manifold locking nut 86 is a conventional metal wing nut that is threaded onto a steel manifold bolt 90 that extends perpendicularly outward from front surface 44 of the heated air discharge manifold. Each steel manifold bolt 90 is inserted through an elongated positioning channel 92 that is formed through each of two parallel oriented sections 94 (only one shown in FIG. 5, both shown in FIG. 4). Elongated positioning channels 92 allow the user to adjust the operational size of elongated heated air discharge vent 80 by positioning lower portion 82 over a portion of elongated heated air discharge vent 80 and then tightening the two manifold locking nuts 86 to hold U-shaped base plate 83 in place.

Figure 6:
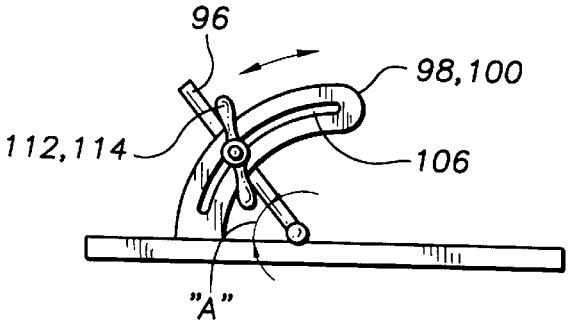
FIG. 6 is a left side plan view of the combination vent restricting and directing assembly in isolation showing the pivoting deflecting panel, the left curved deflecting panel support, and the left deflecting panel locking nut threaded onto the left deflecting panel guide bolt.
Figure 7:
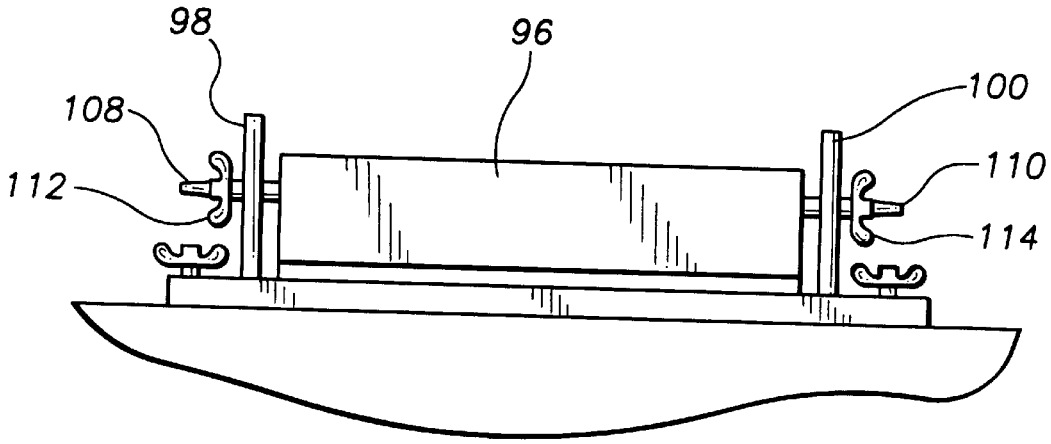
FIG. 7 is a detail underside plan view of the heated air discharge manifold showing a section of the lower forward side edge of the heated air discharge manifold, the two manifold bolts and manifold locking nuts, and the combination vent restricting and directing assembly including the pivoting deflecting panel, the left and right curved deflecting panel supports, and the left and right deflecting panel locking nuts threaded onto the left and right deflecting panel guide bolts.

Combination vent restricting and directing assembly 25 also includes a pivoting deflecting panel 96, identical left and right curved deflecting panel supports 98,100 (right curved deflecting panel support 100 shown in FIG. 8), and a panel locking mechanism, generally designated 102. With reference to FIG. 6, each panel support 98,100 has a curved guide channel 106. Referring to FIG. 7, pivoting deflecting panel 96 has left and right guide bolts 108,110, respectively, that extend through the curved guide channel 106 (FIG. 6) of each left and right curved deflecting panel supports 98,100. Left and right deflecting panel locking nuts 112,114 are threaded, respectively, onto left and right guide bolts 108,110. With reference back to FIG. 6, in use, pivoting deflecting panel 96 is adjusted to deflect the air exiting from elongated heated air discharge vent 80 (FIG. 4) by positioning pivoting deflecting panel 96 at the required angle "A" and then tightening left and right deflecting panel locking nuts 112,114 until pivoting deflecting panel 96 is secured in place.

Figure 8:
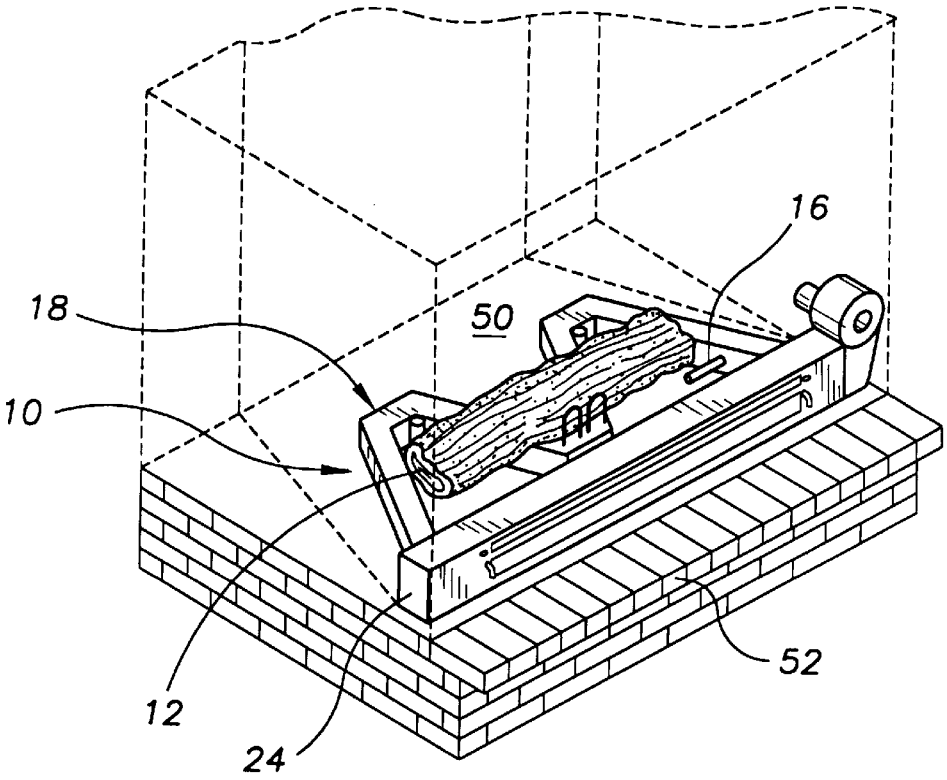
FIG. 8 is a perspective view of the exemplary fireplace heat exchanger of FIG. 1 installed within a representative fireplace.

With reference to FIG. 8, fireplace heat exchanger 10 is installed by replacing the existing fireplace dogs from the fire chamber 50 of a fireplace 52 with heat exchanger unit 18 in a manner such that elongated heated air discharge vent 80 (FIG. 4) is directed outwardly from fire chamber 50 and into the room to be heated. Logs 12 or other suitable burning material are then placed onto heat exchange unit 18 in the same fashion as the previous fireplace dogs and ignited. Operation of fireplace heat exchanger 10 is essentially automatic. Once logs 12 are ignited, the heat generated causes the temperature of the thermocouple in thermocouple extension tube 16 to rise above one-hundred-twenty degrees. The control circuit then activates blower unit 14 causing air to be forced through and heated within heat exchange unit 18 and then discharged through heated air discharge manifold 24 into the room.

It can be seen from the preceding description that a fireplace heat exchanger has been provided that can capture at least a portion of the heat from the burning material within a fireplace and transfer the captured heat into a room; that can be easily installed within an existing fireplace; that includes a mechanism for detecting the presence of a fire within the fireplace and activating an air blower unit for blowing air through a heat exchange unit positioned within the fireplace at a location that allows heat from the burning material to be transferred to the air passing through the heat exchange unit; and that includes a mechanism for detecting when a fire within the fireplace had burned out and deactivating an air blower unit.

It is noted that the embodiment of the fireplace heat exchanger described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A fireplace heat exchanger comprising:

an air blower unit having an input for drawing air into said air blower unit and an output for expelling air from said air blower unit;

a heat exchange unit, in airflow connection with said output of said air blower unit, having at least four heat exchange sections and an airflow passageway running through said at least four heat exchange sections and terminating in a heat exchange output port;

at least one log retainer extending outwardly from an upper surface of said heat exchange unit;

a heated air discharge manifold having a manifold chamber in airflow communication with said heat exchange output port of said heat exchange unit, an elongated air discharge vent formed through a front manifold surface of said heated air discharge manifold into airflow communication with said manifold chamber, and two spaced manifold bolts extending from said front manifold surface thereof;

a combination vent restricting and directing assembly that includes a pivoting deflecting panel, left and right deflecting panel supports extending from a U-shaped base plate having two parallel oriented sections and a lower portion positioned therebetween, and left and right deflecting panel locking nuts threaded onto left and right deflecting panel guide bolts that extend from said pivoting deflector panel, said U-shaped base plate having an elongated positioning channel formed in each of said two parallel oriented sections thereof that are each positioned over one of said two spaced manifold bolts that extend from said front manifold surface, said positioning channels being located and sized such that said lower portion is positionable over a portion of said elongated air discharge vent of said heated air discharge manifold to adjust the operational size of said elongated air discharge vent, said pivoting deflecting panel being pivotally connected to said lower portion; and two manifold locking nuts, each of said manifold locking nuts being threaded onto a threaded manifold bolt end of one of said two spaced manifold bolts.

2. The fireplace heat exchanger of claim 1, further including:

a control circuit having a heat sensing element incorporated therein, said control circuit being in electrical connection with said air blower unit in a manner such that said control circuit activates said air blower unit when said heat sensing element detects the presence of a predetermined temperature.

3. The fireplace heat exchanger of claim 2, further including:

a rear height adjustment mechanism in connection with said heat exchange unit.

4. The fireplace heat exchanger of claim 3, wherein:

said rear height adjustment mechanism includes an internally threaded adjustment nut welded to a sidewall of a rear portion of said heat exchange unit and an externally threaded standoff that includes a central threaded rod section threaded into said internally threaded adjustment nut, said central threaded rod section having a notched upper end for receiving a tip of a screw driver and a lower contact end for contacting a floor surface of a fireplace.

5. The fireplace heat exchanger of claim 4, wherein: said lower contact end is sem-spherical shaped.

6. The fireplace heat exchanger of claim 2, wherein:

said heat sensing element is a thermocouple.

7. The fireplace heat exchanger of claim 6, further including:

a rear height adjustment mechanism in connection with said heat exchange unit.

8. The fireplace heat exchanger of claim 7, wherein:

said rear height adjustment mechanism includes an internally threaded adjustment nut welded to a sidewall of a rear portion of said heat exchange unit and an externally threaded standoff that includes a central threaded rod section threaded into said internally threaded adjustment nut, said central threaded rod section having a notched upper end for receiving a tip of a screw driver and a lower contact end for contacting a floor surface of a fireplace.

9. The fireplace heat exchanger of claim 8, wherein:

said lower contact end is sem-spherical shaped.

10. The fireplace heat exchanger of claim 6, wherein:

said heat sensing element is positioned within a thermocouple extension tube positioned through a sidewall of said heat exchange unit.

11. The fireplace heat exchanger of claim 10, wherein:

said thermocouple extension tube is dogleg shaped.

12. The fireplace heat exchanger of claim 10, further including:

a rear height adjustment mechanism in connection with said heat exchange unit.

13. The fireplace heat exchanger of claim 12, wherein:

said rear height adjustment mechanism includes an internally threaded adjustment nut welded to a sidewall of a rear portion of said heat exchange unit and an externally threaded standoff that includes a central threaded rod section threaded into said internally threaded adjustment nut, said central threaded rod section having a notched upper end for receiving a tip of a screw driver and a lower contact end for contacting a floor surface of a fireplace.

14. The fireplace heat exchanger of claim 13, wherein:

said lower contact end is sem-spherical shaped.

15. The fireplace heat exchanger of claim 1, further including:

a rear height adjustment mechanism in connection with said heat exchange unit.

16. The fireplace heat exchanger of claim 15, wherein:

said rear height adjustment mechanism includes an internally threaded adjustment nut welded to a sidewall of a rear portion of said heat exchange unit and an externally threaded standoff that includes a central threaded rod section threaded into said internally threaded adjustment nut, said central threaded rod section having a notched upper end for receiving a tip of a screw driver and a lower contact end for contacting a floor surface of a fireplace.

17. The fireplace heat exchanger of claim 16, wherein:

said lower contact end is sem-spherical shaped.

* * * * *